United States Patent [19]

Steinbrecher

[11] Patent Number: 5,005,827

[45] Date of Patent: Apr. 9, 1991

[54] LEAPER'S OBSTACLE

[76] Inventor: Gary A. Steinbrecher, Box 101, Scottsbluff, Nebr. 69363-0101

[21] Appl. No.: 484,814

[22] Filed: Feb. 26, 1990

[51] Int. Cl.[5] ..... A63B 5/04

[52] U.S. Cl. ..... 272/102; 24/303

[58] Field of Search ..... 272/102, 101, 103, 93; 24/300, 301, 302, 303; 119/29

[56] References Cited

U.S. PATENT DOCUMENTS

| | | | |
|---|---|---|---|
| 3,009,225 | 11/1961 | Budreck | 24/303 |
| 3,209,729 | 10/1965 | Zedaker | 24/303 |
| 3,439,387 | 4/1969 | Churches | 24/300 |

FOREIGN PATENT DOCUMENTS

| | | | |
|---|---|---|---|
| 2059784 | 4/1981 | United Kingdom | 272/102 |

*Primary Examiner*—Stephen R. Crow

[57] ABSTRACT

A leaper's segmented obstacle bar comprised of two elastic distal end segments each of which have a conventional buckle for strapping one to each of a pair of conventional uprights and having a third soft central segment which contains an elastic portion and an adjustment buckle for adjusting its length to span the distance between and allowing it to be magnetically united with the two distal end segments to form a magnetically united segmented barrier between a pair of conventional uprights.

1 Claim, 2 Drawing Sheets

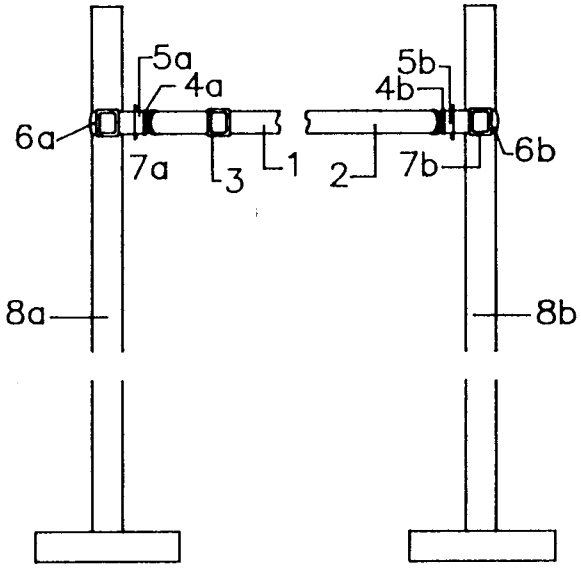
FIGURE #1
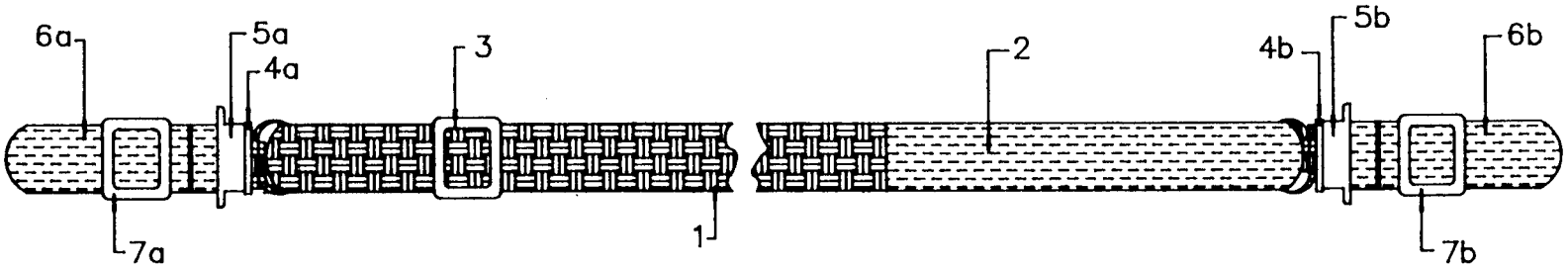
FIGURE #2

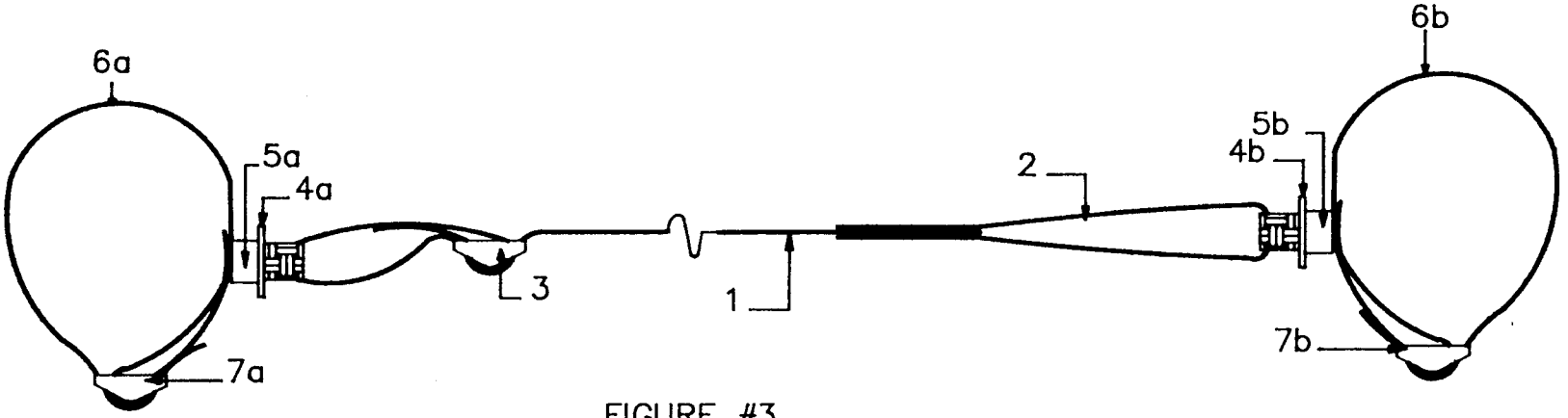
FIGURE #3
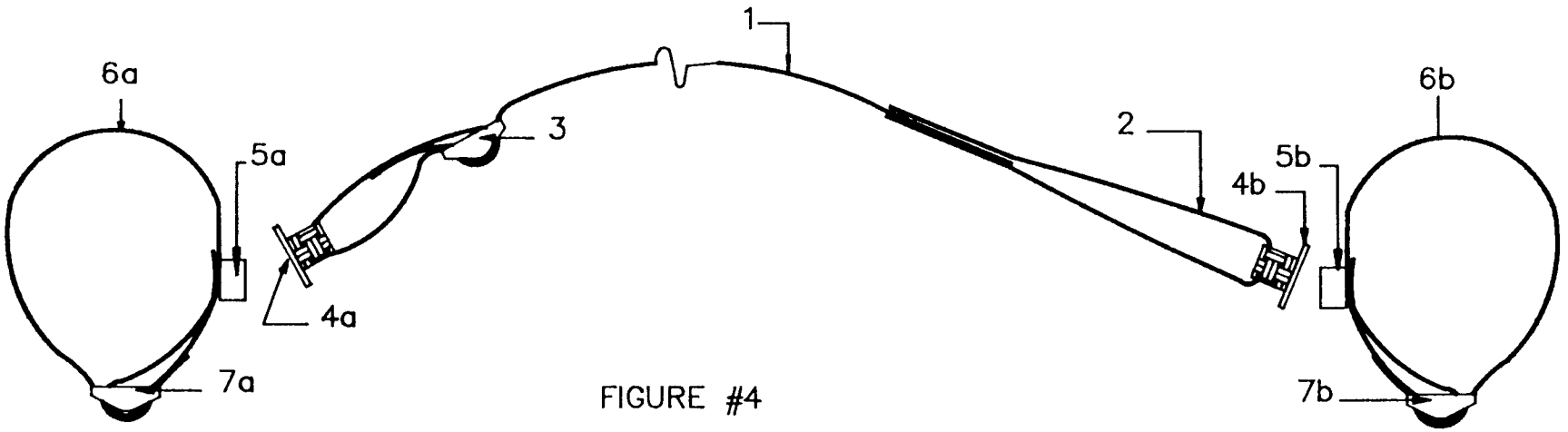
FIGURE #4

LEAPER'S OBSTACLE

FIELD OF THE INVENTION

My invention concerns obstacles of the type used for marking the height of leaps in the exercises of high jumping, pole vaulting, hurdling, horse training, certain games and exercises as well as in circus and theater.

The principal object of my invention is the provision of an improvement in a leaper's obstacle and more particularly in the bar which extends horizontally to form a barrier between a conventional pair of uprights.

A further object of my invention is the provision of a bar which consists of two distal end segments and a third central segment spanning the distance between the two distal end segments to form a horizontal barrier between the two conventional uprights.

A further object of my invention is the provision of a bar which consists of two distal end segments and a third central segment therefor in which the two distal end segments are secured and adjusted by strapping one to each of the conventional uprights.

A further object of my invention is the provision of a bar consisting of two distal end segments and a third central segment in which the two distal end segments are united to the third central segment by magnetic means.

A further object of my invention is the provision of a bar consisting of two distal end segments united magnetically with a third central segment therefor which will provide ready separation of the central segment from the two distal end segments in the event the leaper hits the bar.

A still further object of my invention is the provision of a bar consisting of two distal end segments united magnetically with a third central segment therefor in the event a leaper should contact and separate the third central segment the two distal end segments will retract themselves away from the landing path of the leaper and be left hanging from their respective conventional upright.

PRIOR ART

Conventional bars, rigid or elastic in construction, apart from breaking, remain a single unit while supported or dislodged in the event a leaper hits the bar. Bars of rigid material have the disadvantage of knocking magnetically held hangers off the vertical uprights. Rigid bars on uprights with permanently mounted hangers accordingly can knock over entire vertical uprights. Elastic type bars on the other hand are generally fastened to and stretched horizontally between the vertical uprights. Accordingly they often pull over entire uprights while stretching from the contact of an unsuccessful leaper.

Both rigid and elastic single unit bars suffer from the disadvantage that after each unsuccessful leap they often endanger the leaper by placing rigid material of both bar and upright in the path where the leaper shall complete his landing.

SUMMARY

These objections are overcome by my present invention of a bar which is characterized in that it is comprised of three segments: two distal end segments and a third central segment spanning the distance between the two distal end segments all of which are magnetically united and which allow the third central segment to release when contacted by an unsuccessful leap. The two distal end segments each of which attach one to each of the two conventional uprights have an elastic portion which utilize their elastic properties to retract their permanently fastened magnetic catches out and away from the landing path of the leaper and are left hanging from their respective undisturbed conventional upright.

BRIEF DESCRIPTION OF THE DRAWINGS

With the foregoing and other objects in view, all of which more fully hereinafter appear, my invention comprises certain constructions, combinations and arrangements of parts and elements as hereinafter described, defined in the appended claims, and illustrated in preferred embodiment in the accompanying drawing in which:

FIG. 1 is a view in side elevation of a pair of conventional uprights supporting my improved device.

FIG. 2 is a view in side elevation of my improved device.

FIG. 3 is a view in top elevation of the obstacle in FIG. 2.

FIG. 4 is a view in top elevation of the three segments comprising the whole obstacle shown in FIG. 2.

DESCRIPTION OF THE PREFERRED EMBODIMENTS

Referring now to FIG. 1, the drawing shows a pair of conventional uprights 8*a* and 8*b* and a horizontal bar spanning the distance and forming a barrier between the uprights 8*a* and 8*b*.

Referring now to FIG. 2, the drawing shows the bar used to form the barrier between the uprights 8*a* and 8*b* shown in FIG. 1. The bar being comprised of two distal end segments and a third central segment spanning the distance between the two distal end segments. Each of the two distal end segments are comprised of an elastic strap 6*a* and 6*b*, a fastening buckle 7*a* and 7*b*, and an magnetic fastener 5*a* and 5*b*. The third central segment used to span the distance between the two distal end segments is comprised of a flexible material 1 with a stretchable elastic portion 2, an adjustment buckle 3, and having on each of its two ends a permanently fastened nonsharp ferrous metal connector 4*a* and 4*b*.

Referring now to FIGS. 2, and 3, each of the two distal end segments of the bar contain a conventional fastening buckle 7*a* and 7*b* permanently fastened to the elastic portion 6*a* and 6*b* allowing the elastic portion 6*a* and 6*b* to be strapped one around each of the two said uprights 8*a* and 8*b* shown in FIG. 1. The elastic portions 6*a* and 6*b* each have permanently fastened to them an magnetic catch 5*a* and 5*b* which allows the magnetic catch to extend out and away from the conventional upright and attach itself magnetically to the nonsharp ferrous metal ends 4*a* and 4*b* of the third center segment.

The third central segment which spans the distance between the two distal end segments is comprised of a flexible material 1 with a stretchable elastic portion 2 and having an adjustment buckle 3 both of which the elastic portion 2 and the adjustment buckle 3 allow for adjustment in the overall length required to span the distance between the two distal end segments. The elastic portion 2 stretches to aid in reuniting the central segment with the two distal end segments in the event the bar becomes ununited in a unsuccessful attempt to leap over the bar. On each of the two ends of the third central segment there is a piece of nonsharp ferrous metal 4*a* and 4*b* permanently attached to allow the ends of the central segment to become magnetically attached one to each of the two magnets 5*a* and 5*b* of the distal end segments uniting the segmented bar forming a magnetically united segmented bar shown in FIG. 2.

Referring now to FIG. 4, whenever a leaper or an animal during the exercise of leaping touches the soft middle central segment of the magnetically united segmented bar it causes the nonsharp ferrous metal ends 4*a* and 4*b* of the middle segment to pull free from the magnetic field of the magnets 5*a* and 5*b* of the two distal end segments allowing the middle segment consisting of 1, 2, 3, 4*a* and 4*b* to give way without disturbing the conventional uprights 8*a* and 8*b* shown in FIG. 1. The elastic portion 6*a* and 6*b* of the two distal end segments, each of which are fastened one to each of the uprights 8*a* and 8*b* shown in FIG. 1 uses its elastic properties to retract their permanently fastened magnetic catches 5*a* and 5*b* out and away from the landing path of the leaper and are left hanging from their respective upright 8*a* and 8*b* shown in FIG. 1.

I claim:

1. A leaper's segmented obstacle bar comprising two elastic distal end segments each having a buckle for adjustably looping said end segments to each of a pair of vertical uprights, and a third central segment comprised of soft material having an elastic portion at one end and having a buckle at its other end for providing a length adjustable loop; each said end segment having a magnetic catch and said third central segment having a piece of nonsharp ferrous material at each of its ends for engagement with each respective magnetic catch of said distal end segments, thereby providing a magnetically united segmented barrier between a pair of conventional vertical uprights, whereby the bar separates into unconnected segments during an unsuccessful leap.

* * * * *